US006209721B1

(12) United States Patent
Sharpe et al.

(10) Patent No.: US 6,209,721 B1
(45) **Date of Patent: *Apr. 3, 2001**

(54) GOLF BAG

(75) Inventors: Gordon P Sharpe, Hope Island Resort Gold Coast; Tom Johan Verhoeven, Mudgeeraba, both of (AU)

(73) Assignees: Olympic Proline Pty. Ltd., Labrador; Lake Gifford Pty. Ltd., Madgeeraba, both of (AU)

( * ) Notice: Subject to any disclaimer, the term of this patent is extended or adjusted under 35 U.S.C. 154(b) by 0 days.

This patent is subject to a terminal disclaimer.

(21) Appl. No.: 09/125,189

(22) PCT Filed: Feb. 26, 1997

(86) PCT No.: PCT/AU97/00113

§ 371 Date: Sep. 8, 1999

§ 102(e) Date: Sep. 8, 1999

(87) PCT Pub. No.: WO98/37930

PCT Pub. Date: Sep. 3, 1998

(51) Int. Cl.[7] ..... A63B 55/00

(52) U.S. Cl. ..... 206/315.6; 206/315.2; 206/315.3

(58) Field of Search ..... 206/315.2, 315.3, 206/315.6; 211/70.2

(56) References Cited

U.S. PATENT DOCUMENTS

| | | | | |
|---|---|---|---|---|
| 2,857,168 | | 10/1958 | Neaverson et al. . | |
| 2,860,679 | | 11/1958 | Kouke . | |
| 3,967,667 | | 7/1976 | Robinson | 206/315.6 |
| 3,980,115 | | 9/1976 | Longo | 206/315.6 |
| 4,194,547 | | 3/1980 | Sidor et al. | 206/315.6 |
| 4,332,283 | | 6/1982 | Rader | 206/315.6 |
| 4,664,382 | | 5/1987 | Palmer et al. | 206/315.6 X |
| 4,911,465 | * | 3/1990 | Hauer | 206/315.6 X |
| 4,944,396 | * | 7/1990 | Larkin | 206/315.6 |
| 5,094,345 | * | 3/1992 | Yonnetti | 206/315.6 X |
| 5,135,107 | | 8/1992 | Ingraham | 206/315.6 |
| 5,188,243 | | 2/1993 | Ruiz | 211/70.2 |
| 5,275,278 | * | 1/1994 | Henry et al. | 206/315.6 |
| 5,341,927 | | 8/1994 | Coyner . | |
| 5,575,720 | * | 11/1996 | Daniel | 206/315.6 X |
| 5,613,603 | | 3/1997 | Joh | 206/315.6 |
| 5,720,388 | * | 2/1998 | King et al. | 206/315.6 X |
| 5,775,513 | * | 7/1998 | Anthony | 206/315.6 X |
| 5,834,738 | * | 11/1998 | Wilson | 206/315.3 X |

FOREIGN PATENT DOCUMENTS

| | | |
|---|---|---|
| 1353835 | 5/1974 | (GB) . |
| 2320687A | 1/1998 | (GB) . |
| WO91/02568 | 3/1991 | (WO) . |

* cited by examiner

*Primary Examiner*—Sue A. Weaver
(74) *Attorney, Agent, or Firm*—Rockey, Milnamow & Katz, Ltd.

(57) ABSTRACT

This invention concerns a sports bag such as a golf bag equipped with an organizer insert. In another aspect the invention concerns an organizer insert for a sports bag such as a golf bag. The invention involves an apertured plate, with each aperture being sized and shaped to comfortably receive, for example, a golf club handle. Side walls extend below the plate to define a single compartment beneath each aperture. A spacer is associated with the side walls to keep them in fixed relationship with each other as they extend downwards. A retainer is associated with each compartment to grip a golf club handle and resist its removal from the bag. Golf club handles may be dropped or pushed into the bag through the apertures in the plate. They are gripped by the retainers and are kept relatively still inside their respective compartments. In this way the clubs will be retained in fixed relative locations within the bag, and will be unlikely to fall out of the bag during normal handling. The clubs may be easily removed by gentle upwards pressure applied to the club heads.

9 Claims, 2 Drawing Sheets

GOLF BAG

TECHNICAL FIELD

This invention concerns a sports bag such as a golf bag equipped with an organiser insert. In another aspect the invention concerns an organiser insert for a sports bag such as a golf bag.

1. Background Art

A generally tubular golf bag having an open top to receive golf clubs is well known. The golf clubs are usually dropped into the bag handle first and stand up in the bag with the golf club heads protruding above it. The bags are usually dressed with side pockets to receive golf balls, tees and scoring cards, and they may be carried or wheeled around a golf course.

2. Disclosure of the Invention

In a first aspect, the invention is a sports bag further comprising:

An apertured plate inside the bag near its top, with each aperture being sized and shaped to comfortably receive, for example, a golf club handle. Side walls extend below the plate into the bag to define a single compartment beneath each aperture. Spacer means are associated with the side walls to keep them in fixed relationship with each other as they extend down into the bag. A retainer is associated with each compartment to grip a golf club handle and resist its removal from the bag.

Golf club handles may be dropped or pushed into the bag through the apertures in the plate. They are gripped by the retainers and are kept relatively still inside their respective compartments. In this way the clubs will be retained in fixed relative locations within the bag, and will be unlikely to fall out of the bag during normal handling. The clubs may be easily removed by gentle upward pressure applied to the club heads.

The bag itself may comprise a fairly rigid plastics cylinder closed at the bottom and open at the top. The cylinder may be dressed on the outside with webbing material, or the like, and be provided with pockets, straps and handles as required. A soft material may be provided around the opening of the bag at the top, and the apertured plate may be secured inside the bag near it. The apertured plate may have a circumferential upstanding wall in order to assist in securing it to the bag. The plate itself need not be flat but could be tiered or arranged on a tilt The apertures will generally be arranged in a regular pattern across the plate. They may have a reinforced rim to help prevent wear and damage during rough use. They will typically be sized and shaped to receive only a single golf club handle.

The side walls may comprise sleeves extending below each aperture. The sleeves may be made from tubes of a relatively rigid plastics material open at both ends, and the sleeves may extend into sockets associated with the underside of the plate at each aperture.

The spacer may comprise a plastics disk having holes through it, and the holes may be arranged in the same pattern as the apertures in the plate. The spacer may be arranged in registration with the plate and the sleeves may extend down from their respective apertures trough respective holes in the spacer. The spacer may be arranged to grip the sleeves, or may be fixed to each sleeve by, for instance, adhesive.

One or more retainers may be associated with each compartment, and advantageously a retainer is associated with the upper and lower ends of each compartment. Where the compartments are defined by tubes, the retainers may conveniently comprise a ring of polymer material pushed on to the end of the tube, and having radially inwardly directed resiliently deformable members. The inwardly deformable members would generally extend towards to the axis of the tube but leave a small opening, slightly smaller than the diameter of the golf club handle that will be engaged. Entry of the golf club handle will cause the members to be pressed downwards and spread apart from each other. Greater resistance is provided against withdrawal of the club by the need to pull the members back up while the handle is still in the opening. Since golf club handles are generally wider at their top end than their lower ends, the retainers at the bottom end of each compartment may have an opening of greater diameter than the retainers at the top.

In another aspect the invention concerns an organiser insert for a golf bag as defined above.

BRIEF DESCRIPTION OF THE DRAWINGS

An example of the invention will now be described with reference to the accompanying figures, in which.

The same reference numerals have been used to refer to corresponding elements in both figures.

BEST MODES FOR CARRYING OUT THE INVENTION

Figure 1:
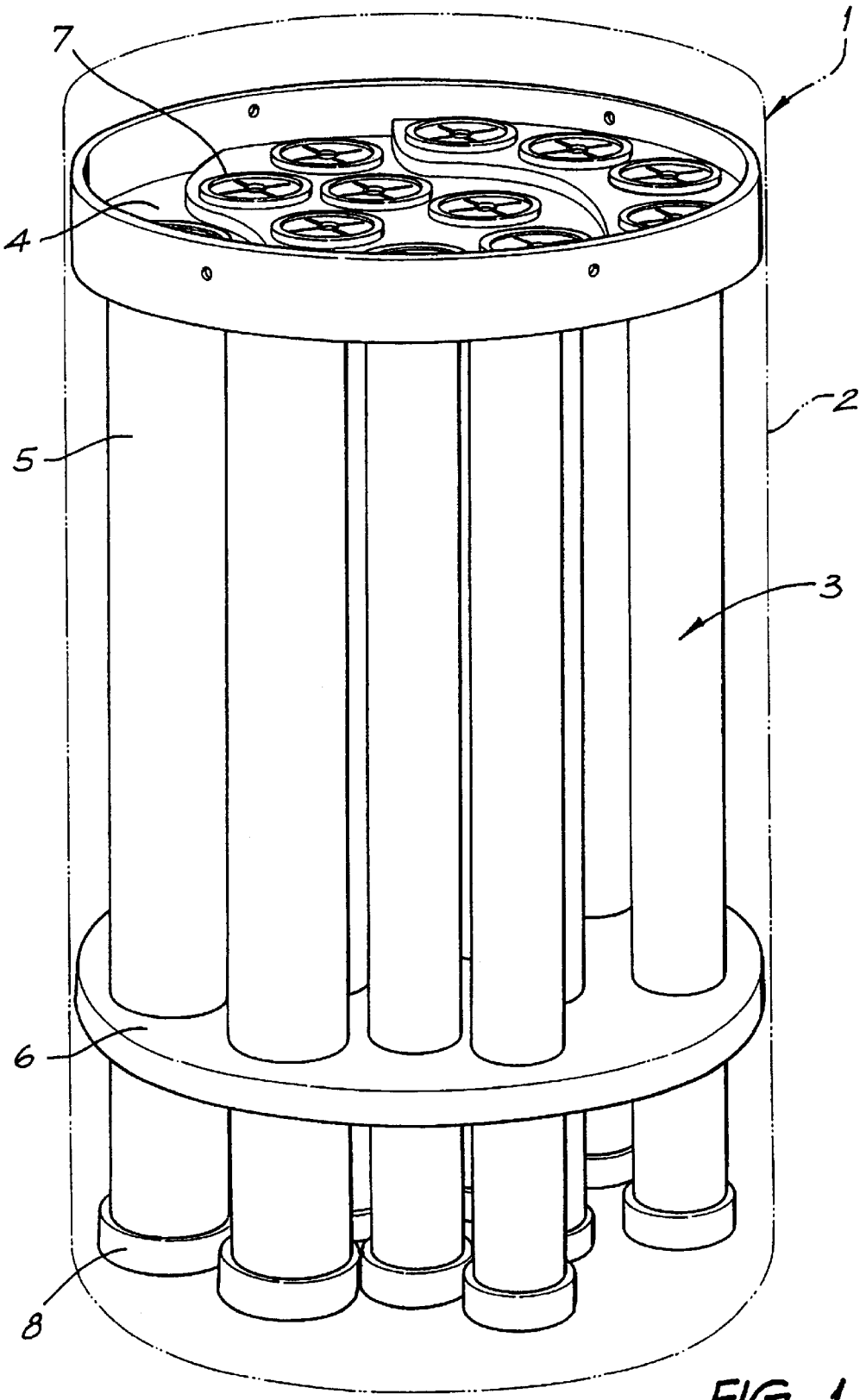
FIG. 1 is a pictorial view of a golf bag organiser insert embodying the invention.
Figure 2:
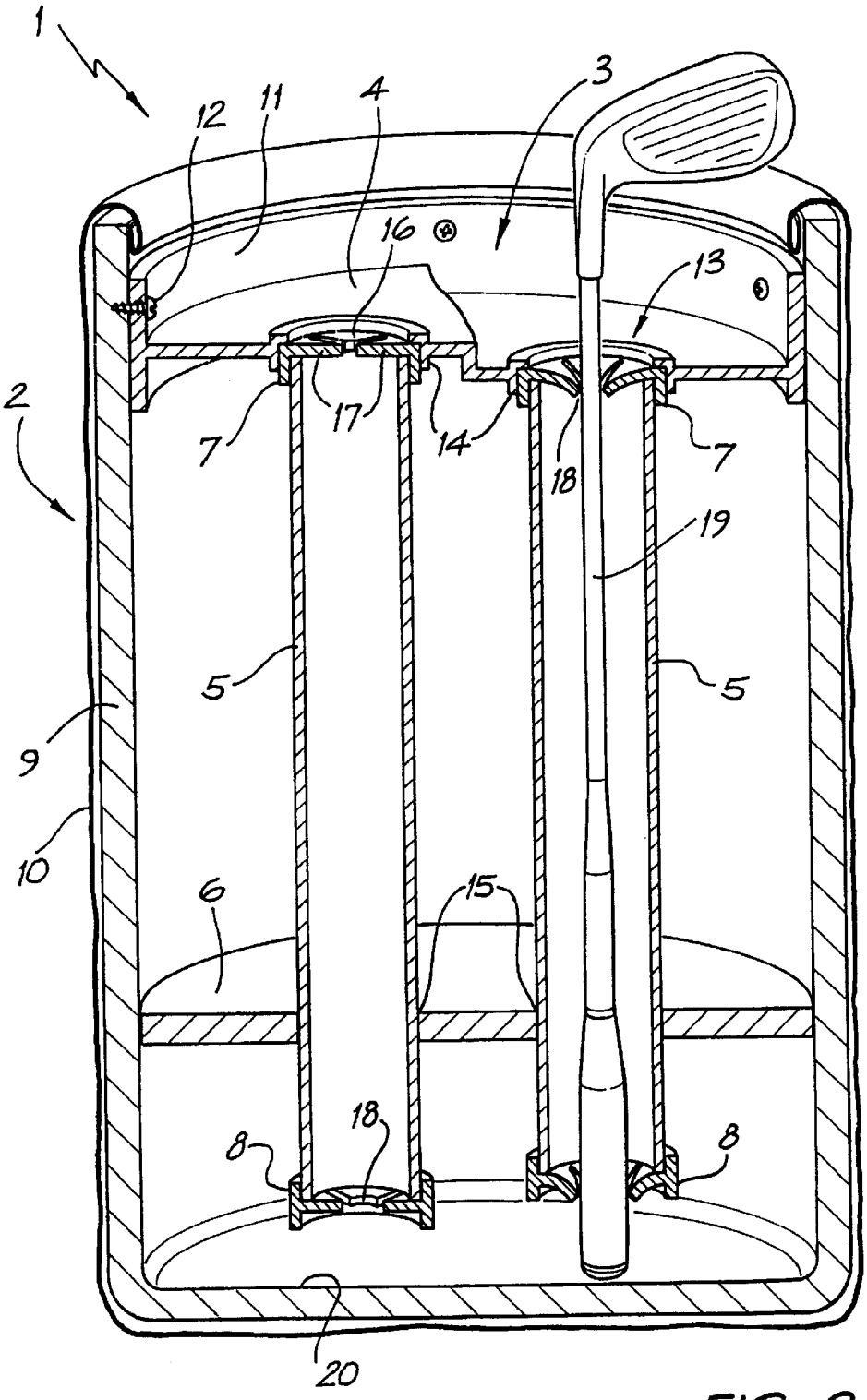
FIG. 2 is a section through a golf bag containing the insert of FIG 1.

Referring to FIG. 1, the generally tubular outer case of golf bag 1 is shown in ghost outline 2. The insert is indicated generally at 3, and comprises an apertured plate 4. Sleeves indicated generally at 5 extend beneath the plate 4. A spacer 6 maintains the sleeves in generally parallel configuration. And retainers 7 and 8 are located at the upper and lower ends of each sleeve respectively.

The case 2 comprises a rigid plastics cylinder 9 closed at the bottom and open at the top. The cylinder 9 is dressed on the outside with fabric 10 that extends around the opening of the bag at the top.

The apertured plate 4 has a circumferential upstanding wall 11 that is secured to the case 2 by means of screws 12. The plate 4 is tiered. The apertures 13 in plate 4 are arranged in a regular pattern across the plate. They are sized and shaped to receive only a single golf club handle.

The sleeves 5 are relatively rigid plastics tubes open at both ends, and the sleeves extend into sockets 14 associated with the underside of the plate 4 at each aperture 13.

The spacer 6 comprises a plastics disk having holes 15 through it, and the holes 15 are arranged in the same pattern as the apertures 13 in the plate 4. The spacer 6 is arranged in registration with the plate 4 and the sleeves 5 extend parallel to each other down from their respective apertures 13 through respective holes 15 in the spacer 6. The holes 15 in the spacer 6 are tight fitting and grip the sleeves.

Retainers 7 are associated with the upper end of each sleeve, and retainers 8 are associated with the lower ends of each sleeve. The retainers 7 and 8 are pushed on to the upper and lower ends of the sleeves respectively. The retainers comprise a ring of polymer material 16 having radially inwardly directed resiliently deformable members 17. The inwardly deformable members 17 extend towards to the axis of the sleeve but leave a small opening 18, slightly smaller than the diameter of the golf club handle that it will engage.

Entry of a golf club handle 19 through an aperture 13 in the plate 4 causes members 17 of the upper retainer 7 to be pressed downwards and spread apart from each other. The club handle is then pushed or dropped into the bag, and the top of the handle passes through the lower retainer 8 to rest on the floor 20 of the bag. Since golf club handles are generally wider at their top ends than their lower ends, the retainers 8 at the bottom end of each compartment may have an opening 18 of greater diameter than the retainers 7 at the top. The members 17 of the retainers press against the handle 19 and center it within the sleeve so that it does not rub against the tube. Since the sleeves are maintained straight and parallel by the plate 4 and the spacer 6, the clubs remain straight within the bag.

Greater resistance is provided against withdrawal of the club by the friction between the members 17 and the handle, which gives rise to the need to pull the members 17 back up while the handle remains in the opening before the handle can be released by the retainers Although the invention has been described with reference to a particular embodiment, it should be appreciated that it may be configured in many other forms. For instance, sleeves of rigid plastics material are not necessary in order to divide the interior of the bag into separate compartments. Also, the spacer may be integrated into the side walls, for instance, in the form of interengaging formations, rather than provided as a separate element. The retainers may be made of rubber or any other suitable materials such as elastomeric material with high memory and good resistance to ultraviolet degradation. Alternatively, retainers of completely different form may be employed. The invention may also be applied to other types of sports bags, such as bags for tennis rackets.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

What is claimed is:

1. A sports bag having an entry and comprising:

an apertured plate inside the bag near the entry, the plate having plural apertures with each aperture being sized and shaped to receive a handle of a sports implement;

side walls extending beneath the plate into the bag to define a single compartment beneath each aperture;

at least one spacer associated with the side walls to keep the side walls in fixed relationship with each other as the side walls extend down into the bag; and a similar retainer located at each of the upper and lower ends of each compartment and adapted to grip a handle, to keep the gripped handle away from the side walls defining said compartment, and to resist removal of the gripped handle from the bag, each retainer being adapted to allow the handle to pass downwardly through said retainer.

2. A sports bag according to claim 1, wherein the side walls comprise sleeves extending below each aperture.

3. A sports bag according to claim 2, wherein the sleeves comprise tubes open at both ends.

4. A sports bag according to claim 1, wherein the apertures in the plate are arranged in a pattern, the spacer means comprises a plastics disk having holes, and the holes are arranged in the same pattern as the apertures in the plate.

5. A sports bag according to any one of claims 1, 2, 3, or 4, wherein the retainer located at each of the upper and lower ends of each compartment is adapted to grip a handle automatically when the handle is inserted into said compartment.

6. A sports bag according to claim 5, wherein the retainer located at each of the upper and lower ends of each compartment is adapted to center a handle within said compartment when the handle is inserted into said compartment.

7. A sports bag having an entry and comprising:

an apertured plate inside the bag near the entry, the plate having plural apertures with each aperture being sized and shaped to receive a handle of a sports implement;

side walls extending beneath the plate into the bag to define a single compartment beneath each aperture;

spacer means associated with the side walls to keep the side walls in fixed relationship with each other as the side walls extend down into the bag; and a similar retainer located at each of the upper and lower ends of each compartment and adapted to grip a handle, to keep the gripped handle away from the side walls defining said compartment, and to resist removal of the gripped handle from the bag, each retainer being adapted to allow the handle to pass downwardly through said retainer.

8. A sports bag organizer insert according to claim 7 wherein the retainer located at each of the upper and lower ends of each compartment is adapted to grip a handle automatically when the handle is inserted into said compartment.

9. A sports bag organizer insert according to claim 8, wherein the retainer located at each of the upper and lower ends of each compartment is adapted to center a handle within said compartment when the handle is inserted into said compartment.

* * * * *